United States Patent [19]

Giussani

[11] Patent Number: 4,536,610

[45] Date of Patent: Aug. 20, 1985

[54] OIL-FILLED, MULTI-CORE CABLE WITH AT LEAST ONE CONDUCTOR DIFFERING FROM OTHERS

[75] Inventor: Alberto Giussani, Milan, Italy

[73] Assignee: Societa' Cavi Pirelli, S.p.A., Milan, Italy

[21] Appl. No.: 621,442

[22] Filed: Jun. 18, 1984

[30] Foreign Application Priority Data

Jun. 21, 1983 [IT] Italy ..... 21700 A/83

[51] Int. Cl.[3] ..... H01B 9/06

[52] U.S. Cl. ..... 174/26 R; 174/15 C; 174/25 R

[58] Field of Search ..... 174/26 R, 26 G, 25 R, 174/25 G, 15 C

[56] References Cited

U.S. PATENT DOCUMENTS

| | | | |
|---|---|---|---|
| Re. 28,425 | 5/1975 | Priaroggia et al. | 174/15 C X |
| 1,710,845 | 4/1929 | Simons | 174/26 R |
| 1,959,339 | 5/1934 | Bennett | 174/26 R |
| 2,006,932 | 7/1935 | Rosch | 174/25 R |
| 2,050,991 | 8/1936 | Atkinson | 174/25 R |
| 2,112,322 | 3/1938 | Wyatt | 174/25 R |
| 2,457,436 | 12/1948 | Bennett | 174/15 C |
| 3,775,549 | 11/1973 | Matsuda et al. | 174/120 FP X |
| 3,780,206 | 12/1973 | Reynolds | 174/25 R X |
| 4,118,593 | 10/1978 | Borroni | 174/26 R |

FOREIGN PATENT DOCUMENTS

| | | | |
|---|---|---|---|
| 94327 | 12/1959 | Netherlands | 174/26 R |
| 195085 | 12/1923 | United Kingdom | 174/26 R |
| 403616 | 3/1932 | United Kingdom | 174/25 P |

*Primary Examiner*—A. T. Grimley
*Assistant Examiner*—Morris H. Nimmo
*Attorney, Agent, or Firm*—Brooks Haidt Haffner & Delahunty

[57] ABSTRACT

An oil-filled, multi-core, electric cable having three cores within a metal sheath. Each core has a conductor surrounded by insulation and has substantially the same outer dimensions as the other cores. One conductor is made of copper and has a central oil duct. The other conductors are made of stranded aluminum wires in side-by-side and contacting relation and the ratio of the cross-sectional area of the metal of the copper conductor to the cross-sectional area of the metal of each aluminum conductor is the reciprocal of the ratio of the electrical conductivities thereof.

10 Claims, 2 Drawing Figures

OIL-FILLED, MULTI-CORE CABLE WITH AT LEAST ONE CONDUCTOR DIFFERING FROM OTHERS

The present invention relates to an oil-filled, multi-core cable and more particularly to an oil-filled, multi-core cable especially suitable for use as a submarine cable.

The known oil-filled, multi-core cables are made up with a plurality of cores laid-up together and are enclosed within a metal sheath, and fillers, impregnated with an insulating, fluid oil, are interposed in the interstices existing between the cable cores and between these latter and the metal sheath. Each core comprises a conductor covered with an insulation, constituted at least by a winding of a tape of material selected from cellulose, synthetic or mixed material and impregnated with an insulating, fluid oil.

To enable the insulating, fluid oil impregnating all the cable elements encased within the sheath to move along the cable itself, ducts must be provided in this latter for the longitudinal movement of the oil. Different types of oil-filled, multi-core cables are known.

In a first type of known oil-filled, multi-core cables, the ducts for the movement of the insulating oil along the cable are constituted by cylindrical helicoids of tapes of metal, having helices spaced from one another, embedded in the interstices existing between the metal sheath and the cable cores. This first type of known oil-filled, multi-core cables presents some drawbacks when used as submarine cable, due especially to the particular structure of the duct provided therein for the movement of the insulating fluid oil along the cable.

In fact, when this first type of oil-filled, multi-core cable is used as submarine cable, where the risk of ruptures of the cable sheath, as a consequence of being bumped by anchors or fishing nets, is always present, the leakages of insulating fluid oil from the cable are very high and the risk of entry and migration of water into the cable is also high.

This is due to the particular structure and position of the ducts for the movement of the insulating fluid oil along the cable which firstly, are near the cable sheath and secondly, are made up of open helices of metal tape. Therefore, said ducts cannot offer any resistance both to the escape of insulating, fluid oil circulating therein and to the entry of water into the cable, and such ducts do not permit the use of means for avoiding the propagation of water along the cable.

In a second type of known oil-filled, multi-core cables, the ducts for the movement of the insulating fluid oil along the cable consist of tubular ducts provided at the center of each of the conductors of the cable cores.

Even though with this second type of known oil-filled, multi-core cable, the risks of having great leakages of insulating, fluid oil in case of rupture of the cable sheath are reduced, there is the drawback that, with transmissible power of the known oil-filled, multi-core cables of the first type equal to that of the second type, the weight of those of the second type is greater. In fact, to provide the ducts for the movement of the insulating, fluid oil along the cable in the conductors, it is necessary to increase the diametral dimensions of the latter and consequently, to increase the diametral dimensions of the cable with an evident weight increase of the cable itself.

One object of the present invention is that of overcoming the drawbacks existing in the known oil-filled, multi-core cables, i.e. to provide an oil-filled, multi-core cable which, in case of rupture of the cable sheath, has fairly small leakages of insulating, fluid oil from the cable and at the same time permits a reduction in the weight of the cable for equal power transmission capability.

One object of the present invention is an oil-filled, multi-core cable comprising a metal sheath enclosing a plurality of cores laid up together, each of said cores comprising a conductor covered with an insulation comprising at least a winding of a tape of a material selected from cellulose, synthetic and mixed material, which is impregnated with an insulating, fluid oil, characterized by the fact that the conductor of at least one cable core is made of a metallic material having electrical conductivity higher than that of the metallic material forming the conductors of the remaining cable cores, said conductors of a metallic material having a higher electric conducitivity having a duct for the movement of the insulating, fluid oil along the cable whereas the conductors of a material having a lower electric conductivity are compact strands.

In particular, in an oil-filled, multi-core cable according to the present invention, the conductors of a metallic material having a higher electrical conductivity are formed by keystone-shaped conductors placed side-by-side so as to define therein a duct for the movement of the insulating oil whereas the conductors of a metallic material having a lower electrical conductivity are compact strands, for example, strands of wire, or keystone-shaped conductors, laid-up together.

Further, the ratio between the area of the cross-section of the conductors having a higher electrical conductivity occupied by the said metallic material having a higher electrical conductivity and the area of section occupied by the metallic material having a lower electrical conductivity by which the other conductors are formed, is substantially equal to the reciprocal of the ratio between the electrical conductivities of the said materials.

Finally, in an oil-filled, multi-core cable according to the present invention, into the duct for the movement of the insulating fluid oil along the cable in the conductors of metallic material having a higher electrical conductivity, there is inserted means for reducing the area of said duct section at points spaced apart from one another. Said means are preferably made up of small cylinders provided with a through opening as described in U.S. Pat. No. Re. 28,425.

Other objects and advantages of the present invention will be apparent from the following detailed description of the presently preferred embodiments thereof, which description should be considered in conjunction with the accompanying drawings in which:

FIGS. 1 and 2 show cross-sections of a preferred embodiment of an oil-filled, three-core cable according to the present invention which is the simplest case of an oil-filled, multi-core cable to which the present invention refers, but it is to be understood that the invention is applicable to multi-core cables having a different number of cores.

Further, the sections shown in the figures do not illustrate the usual longitudinal coverings, metallic reinforcement, armors which generally are placed around the cable sheath since they are per se known.

Figure 1:
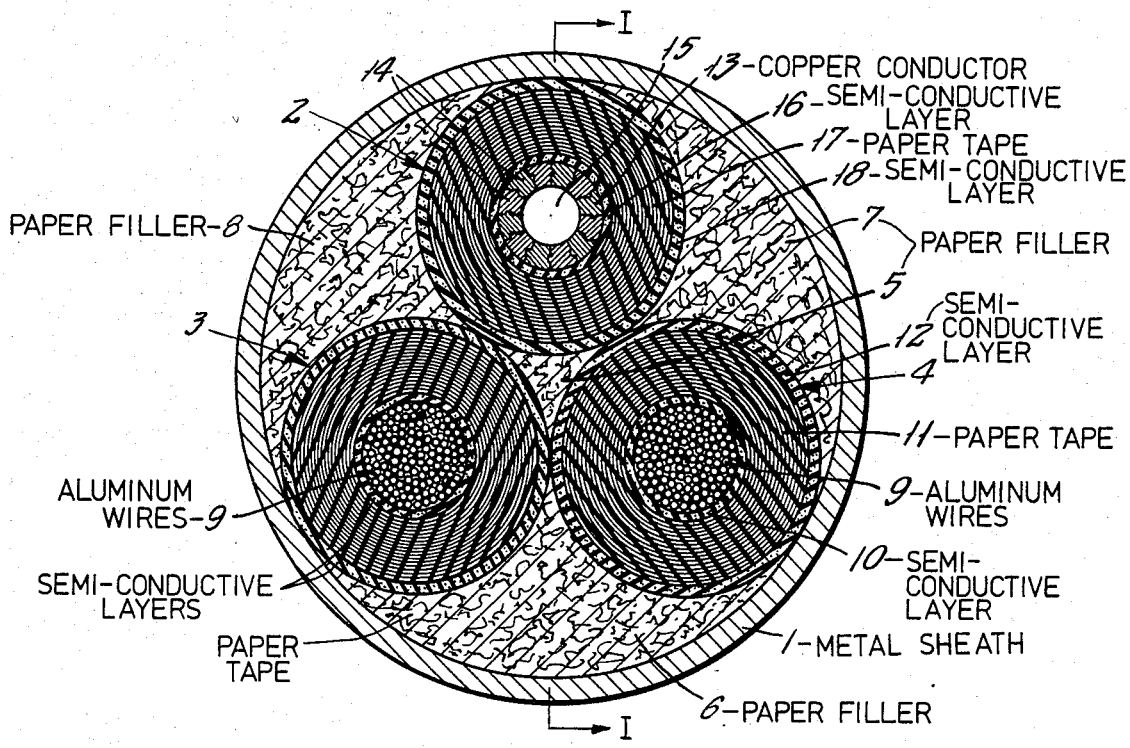
FIG. 1 is a cross-sectional view of an oil-filled, multi-core cable according to the present invention omitting, however, the cable parts outside the metal sheath.
Figure 2:
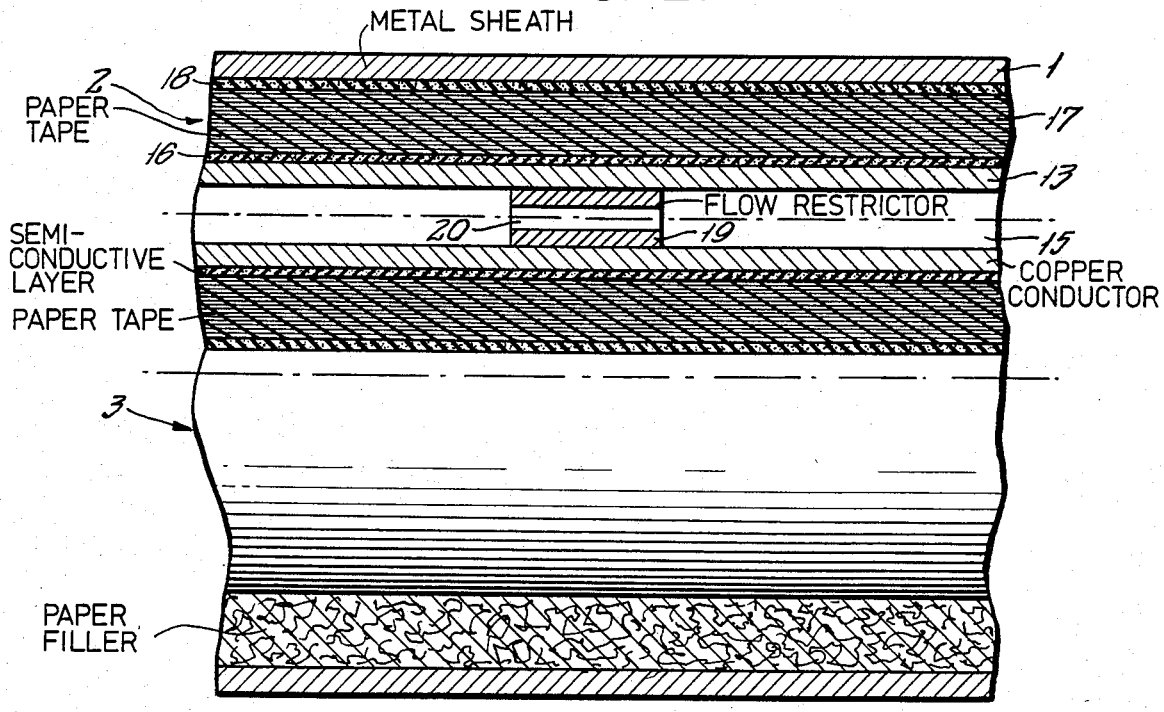
FIG. 2 is a longitudinal, cross-sectional view of the embodiment shown in FIG. 1 taken along the line I—I shown in FIG. 1.

As shown in FIGS. 1 and 2, within a metal sheath 1, for example, of lead, of aluminum, there are housed three cores 2, 3 and 4 which are later described in detail. Said cores have in substance all the same outer diametral dimensions.

The cable cores 2, 3 and 4, besides being in contact with one another, are in direct contact with the cable sheath 1. Consequently, interstices are formed between the cable cores and between these latter and the sheath 1, and such spaces are filled with fillers 5–8 of insulating material, preferably of paper.

An insulating, fluid oil, per se known, is present in the entire space enclosed within the sheath 1. Said oil is, for example, an alkylbenzene which impregnates both the cable cores 2, 3 and 4 and the fillers 5–8 present in the interstices.

As previously stated, the cable cores 2, 3 and 4 are present within the sheath 1. The cores 3 and 4 are equal to each other in size and are constituted as set forth hereinafter.

Each of said cores 3 and 4 comprises a compact conductor 9 formed by a plurality of aluminum wires laid-up together. Thus, the wires of conductor 9 contact each other and in cross-section, completely fill a circle which contains the periphery of the conductor 9 so that there are no spaces between the wires other than those caused by the fact that the wires are circular in cross-section. Around the conductor 9 there is a first, semi-conductive layer 10 formed by windings of semi-conductive paper tapes. An insulating layer 11 formed by a plurality of windings of insulating material tapes, in particular, paper tapes impregnated with insulating, fluid oil, is around the first, semiconductive layer 10. The layer of insulating material 11 is covered with a second, semi-conductive layer 12 formed by windings of semi-conductive material tapes.

The cable core 2 differs from the cores 3 and 4, previously described, with respect to the conductor present therein. In fact, the conductor 13 of the core 2, the outer diameter of which is equal to that of the conductors 9, is constituted by a copper element stranded so as to form a tube, i.e. by elements of a material having a conductivity higher than the conductivity of the wires forming the conductors 9 of the cores 3 and 4 which are of aluminum.

Moreover, the ratio between the area occupied by the copper in a cross-section perpendicular to the axis of the conductor 13 and the area occupied by the aluminum in a section perpendicular to the axis of one of the conductors 9 is substantially equal to the reciprocal of the ratio between electrical conductivity of the copper, which is 1000/17.241 m/ohm/mm$^2$, and that of the aluminum, which is 1000/28.264 m/ohm/mm$^2$, i.e. the electrical conductivity of the aluminum is substantially only 61% of the conductivity of copper.

For example, for a three-core cable, the nominal area occupied by the copper in cross-section perpendicular to the axis of the conductor 13 is 240 mm$^2$ while that occupied by the aluminum in cross-section perpendicular to the axis of one of the conductors 9 is 400 mm$^2$.

In particular, the conductor 13 is constituted by a strand formed by a plurality of keystone-shaped conductors 14 (known per se) placed side-by-side and laid-up together so as to define, at the center of the conductor 13, a duct 15 constituting the duct for the movement of the insulating, fluid oil along the cable.

A first, semi-conductive layer 16, like the semi-conductive layers 10 of the cores 3 and 4 is provided around the conductor 13. An insulating layer 17, impregnated with an insulating, fluid oil and formed by a plurality of windings of insulating material tapes, for instance, tapes of cellulose material, is provided around the semi-conductive layer 16. Finally, a semi-conductive layer 18, constituted by windings of semi-conductive material tapes, is provided around the insulating layer 17.

As previously stated, the cable cores according to the present invention differ from one another because of the conduction of the conductors therein. In its more general aspects, in an oil-filled, multi-core cable, according to the present invention, at least one of the conductors of the cable cores is of a metallic material having an electrical conductivity higher than that of the metallic material forming the conductors of the remaining cable cores. Comparing the cross-sections of the two types of conductors present in a cable according to the present invention, the ratio between the area of the metallic material having a higher electrical conductivity of the one conductor and the area of the material having a lower electrical conductivity or one of the other conductors is equal to the reciprocal of the ratio between the electrical conductivities themselves. In other words, the ratios of the areas of the metals is selected so that the resistance of the conductor made of lower conductivity metal is the same or substantially the same as the resistance of the conductor made of higher conductivity metal.

Moreover, the structure of the conductor of metallic material having a higher electrical conductivity is such as to provide a duct in the conductor for the movement, under pressure, of the insulating, fluid oil along the cable when it is desired that the maximum temperature which can be reached by this conductor does not exceed, during the operation of the cable, a prefixed value.

Preferably, in an oil-filled, multi-core cable according to the present invention, means are provided to reduce, at points spaced apart from one another along the cable, the area of the section of the duct or ducts which are in the conductors of metallic material having an electric conductivity higher than that of the other conductors of the cable cores.

FIG. 2 shows a particular embodiment of the just cited means.

As shown in FIG. 2, the means for reducing the area of the section of a duct 15 for the longitudinal movement of the fluid oil within the cable is constituted by a restrictor having the shape of a small cylinder 19 provided with a through opening 20 of diametral dimensions smaller than those of the duct 15 at the center of the conductor 13 of the cable core 2.

From the previous description, it is easily understood that the oil-filled, multi-core cable, according to the present invention, accomplishes the stated objects.

In fact, with an oil-filled, multi-core cable according to the present invention, it is possible to have, in the case of a rupture of the cable sheath, leakages of insulating, fluid oil from the cable very much less than the leakages occurring with the known oil-filled, multi-core cables of the first type.

While in the known oil-filled, multi-core cables of the first type, where the ducts for the movement of the insulating fluid oil along the cable are constituted by open helices of metallic material inserted into the interstices of the cable, barriers do not exist, nor can be foreseen, which will withstand the escape of oil from the cable and the entry and migration of water along the cable. In the case of an oil-filled, multi-core cable according to the present invention, the presence of the insulation around the cable conductors in which there is the oil duct constitutes an efficient barrier against the escape of oil from the cable and against the entry of water into the cable.

Moreover, by means of an oil-filled, multi-core cable according to the present invention, it is possible to obtain a reduction in weight with respect to the known oil-filled, multi-core cables of the second type since it is possible to make recourse to different metallic materials for the formation of the conductors of the cables. Therefore, exploiting the possibility offered by the use of different metallic material for the formation of cable conductors, it is possible to get an advantage out of the specific gravity differences existing among said different metallic materials. In fact, for example, in the case in which aluminum is used as the material having a lower conductivity and copper is used as the material having a higher conductivity, the obtaining of reduced weights for a cable is immediately apparent since aluminum has a specific gravity which is one-third of that of the copper.

As is known in the art, the insulation 11 and 17, the semi-conductive layers 10, 12, 16 and 18, the fillers 5–8 and the strand formed by the plurality of conductors 14 are permeable to the insulating, fluid oil so that oil in the duct 15 can flow out of the duct 15 into the other elements or return to the duct 15 from the other elements with operating temperature changes.

Although preferred embodiments of the present invention have been described and illustrated, it will be apparent to those skilled in the art that various modifications may be made without departing from the principles of the invention.

The embodiments of the invention in which an exclusive property or privilege is claimed are defined as follows:

1. An oil-filled, multi-core, electric cable comprising a metal sheath surrounding a plurality of cores, each of said cores comprising a metal conductor covered with oil-permeable insulation impregnated with a fluid, insulating oil, the conductor of at least one, but less than all, of said cores being made of a metal having an electrical conductivity higher than the electrical conductivity of the metal of the conductor of at least one other of said cores, each conductor made of a metal of higher conductivity having a longitudinal duct therein for the movement of said fluid, insulating oil along the duct and each conductor made of a metal of a lower conductivity being a compact strand of metal wires which substantially fill the space within a circle containing the periphery of said strand.

2. An oil-filled, multi-core, electric cable as set forth in claim 1 wherein said conductor of at least one of said cores comprises a plurality of keystone-shaped conductors in side-by-side relation to form a tube, the bore of said tube providing said duct.

3. An oil-filled, multi-core, electric cable as set forth in claim 2 wherein the conductor or conductors of the other core or cores comprises a plurality of wires in side-by-side relation.

4. An oil-filled, multi-core, electric cable as set forth in claim 1 wherein the conductor or conductors of the other core or cores comprises a plurality of wires in side-by-side relation.

5. An oil-filled, multi-core, electric cable as set forth in claim 1 wherein the ratio of the cross-sectional area of the metal of said conductor of at least one, but less than all, of said cores having a higher electrical conductivity to the cross-sectional area of the metal of the conductor of said other of said cores is substantially equal to the reciprocal of the ratio of the electrical conductivity of said metal having a higher electrical conductivity to the electrical conductivity of the metal of the conductor of said other of said cores.

6. An oil-filled, multi-core, electric cable as set forth in claim 1 further comprising a plurality of spaced apart oil flow restrictors in said duct, said oil flow restrictors reducing the cross-sectional area of said duct.

7. An oil-filled, multi-core, electric cable as set forth in claim 6 wherein said oil flow restrictors are cylinders with a through opening smaller than the size of said duct.

8. An oil-filled, multi-core, electric cable as set forth in claim 1 wherein said cores have substantially equal outer dimensions and are in contact with each other and the interior of said sheath.

9. An oil-filled, multi-core, electric cable as set forth in claim 5 wherein said cores have substantially equal outer dimensions and are in contact with each other and the interior of said sheath.

10. An oil-filled, multi-core, electric cable as set forth in claim 1 wherein said metal having a higher electrical conductivity is copper and the metal of the conductor of said other core is aluminum.

* * * * *